US007770293B2

(12) United States Patent
Amend

(10) Patent No.: US 7,770,293 B2
(45) Date of Patent: Aug. 10, 2010

(54) METHOD FOR MANUFACTURING COMPOSITE BUILDING PANELS

(75) Inventor: Victor Amend, 116 Newton Drive, Toronto, Ontario (CA) M2M 2N1

(73) Assignee: Victor Amend, Toronto, Ontario (CA)

( * ) Notice: Subject to any disclaimer, the term of this patent is extended or adjusted under 35 U.S.C. 154(b) by 1107 days.

(21) Appl. No.: 11/250,470

(22) Filed: Oct. 17, 2005

(65) Prior Publication Data

US 2007/0095010 A1 May 3, 2007

(51) Int. Cl.
*B21D 47/00* (2006.01)
*E04C 1/00* (2006.01)

(52) U.S. Cl. ..... 29/897.32; 29/897.312; 29/411; 29/417; 29/469; 52/309.7; 52/309.12

(58) Field of Classification Search ..... 29/897.32, 29/897.3, 897.31, 897.312, 411, 417, 469; 52/309.7, 309.12, 309.16, 309.17
See application file for complete search history.

(56) References Cited

U.S. PATENT DOCUMENTS

| | | | | | |
|---|---|---|---|---|---|
| 2,969,619 | A | | 1/1961 | Didrick | |
| 3,470,598 | A | * | 10/1969 | Berthelsen | 29/897.312 |
| 4,145,861 | A | | 3/1979 | Yarnick | |
| 4,241,555 | A | | 12/1980 | Dickens et al. | |
| 4,619,096 | A | | 10/1986 | Lancelot, III | |
| 4,953,334 | A | | 9/1990 | Dickens | |
| 5,285,607 | A | * | 2/1994 | Somerville | 52/235 |
| 5,664,382 | A | * | 9/1997 | Melnick et al. | 52/425 |
| 5,792,481 | A | | 8/1998 | Creti | |
| 5,822,940 | A | * | 10/1998 | Carlin et al. | 52/479 |
| 5,845,445 | A | | 12/1998 | Blackbeard | |
| 6,272,749 | B1 | * | 8/2001 | Boeshart et al. | 29/897.32 |
| 6,314,694 | B1 | | 11/2001 | Cooper et al. | |
| 6,526,713 | B2 | | 3/2003 | Moore, Jr. | |
| 6,536,172 | B1 | | 3/2003 | Amend | |
| 6,892,507 | B1 | * | 5/2005 | Pease | 52/794.1 |
| 2005/0034418 | A1 | | 2/2005 | Bravinski | |

OTHER PUBLICATIONS

SRI, Inc.; "Isorast 2000—Floor/Ceiling"; Internet web page; Oct. 22, 2003; http://www.isorast2000.com/artman/publish/floor.shtml.
Insul-Deck;"Lightweight Forming System for Concrete Floors and Roofs"; product brochure; 2002; www.insul-deck.org.

* cited by examiner

*Primary Examiner*—David P Bryant
*Assistant Examiner*—Sarang Afzali
(74) *Attorney, Agent, or Firm*—Matthew D. Powell

(57) ABSTRACT

A method for manufacturing frame-type composite panels to a desired length comprises forming an elongate core-frame composite in which frame members have been received in slots on a slab of core material. The composite is cut to the desired length and the frame is finished by application of end members. The method described herein allows composite frame panels to be formed without restriction on the length typically due to the length of the mold in which the core is formed. A drum for use in a system for creating composite panels is disclosed having protruding rings concentric to the drum. A slab of core material is passed between two such drums which form slots in the slab for receiving frame members when they contact the slabs.

18 Claims, 19 Drawing Sheets

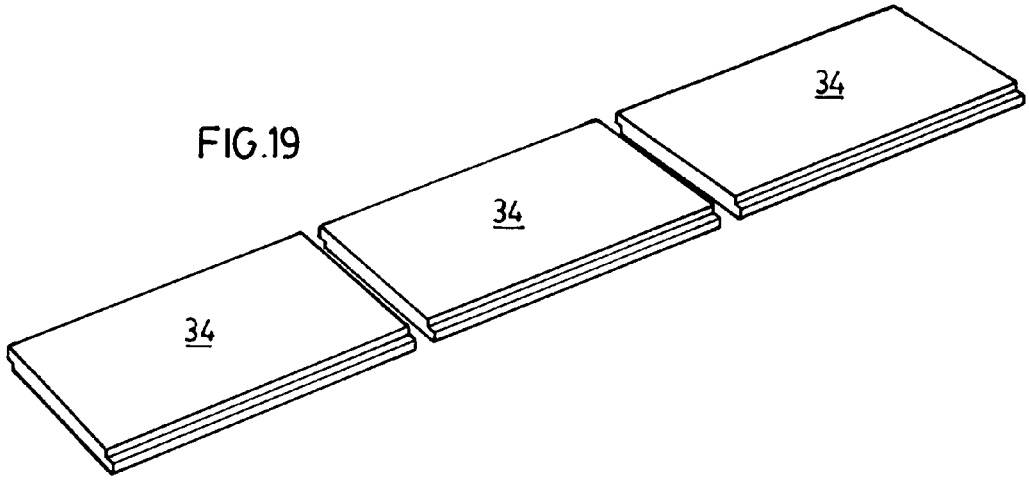
FIG.19
FIG.20
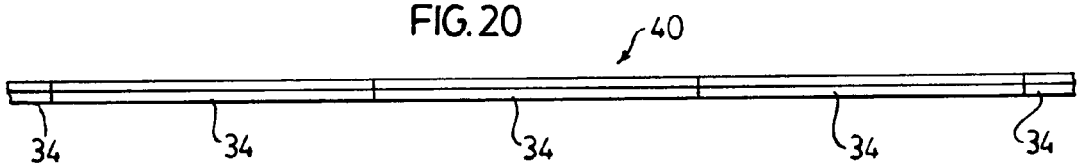
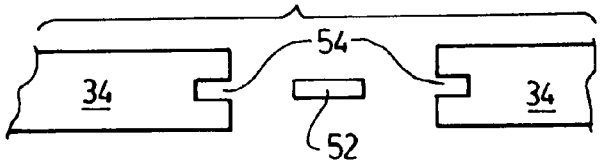
FIG. 21

METHOD FOR MANUFACTURING COMPOSITE BUILDING PANELS

FIELD OF THE INVENTION

The present invention relates generally to prefabricated composite panels for use in building construction and in particular, to a method for fabricating frame-type composite panels.

BACKGROUND OF THE INVENTION

Prefabricated composite building panels are well known for providing a means by which builders can quickly erect structures of high strength and having excellent thermal insulating properties. Composite panels are typically used to construct walls, ceilings and floors for factory buildings, cold rooms, agricultural growing rooms, office buildings, warehouses and portable buildings, but have many other applications.

Such composite panels typically comprise an insulating core, of polystyrene, polyurethane, polyethylene, or mineral fibre. Laminate-type composite panels have skins of steel, wood, gypsum, aluminum, plastic or the like adhered to the insulating core and are suitable for many applications. Frame-type composite panels have a frame of steel, wood or plastic affixed about the insulating core. Because the insulating core in a frame-type composite panel is not completely covered by a sheet of laminate, such a panel is better suited than its laminate-type counterpart for forming conduits for electrical systems and mounting drywall to its frame during building construction.

Frame-type composite panels may be connected to each other during building construction by affixing overlapping portions of frame members of adjacent panels using nut/bolt combinations, rivets, clips or the like.

Various methods of manufacturing frame-type composite panels are known. For example, U.S. Pat. No. 4,241,555 to Dickens et al. discloses a method of manufacturing such a panel. Dickens forms the insulating core by applying heat to a core-shaped mold containing expandable polystyrene (EPS). The EPS expands under the application of heat to fill the mold, thus creating a single panel's core. Once the core is removed from the mold, flat reinforcing frame strips are adhered to the faces of the core and to each other in order to frame the core. As an alternative, Dickens proposes placing the reinforcing strips into the mold prior to heating the EPS chips such that the polystyrene is expanded to fill the frame during expansion. U.S. Pat. No. 4,953,334 also to Dickens discloses an improved panel wherein the reinforcing strips include bent-over edges. When the EPS is expanded in the mold, the bent-over edges extend into the insulated core to provide increased panel stiffening.

While Dickens' method is sufficient for creating frame-type composite panels, the length of the panels produced is inherently restricted to the size of the core mold. However, as mold length is increased in order to create larger panels, it becomes increasingly difficult to uniformly regulate the application of EPS-expanding heat. As a result, the final product of such a process can suffer from inconsistencies.

Machine Development International (MDI) of Australia manufactures specialized systems for creating laminated composite panels of customs lengths. MDI's systems create laminated panels by forming individual core slabs, joining them end-to-end, and then applying the sheets of laminate end-to-end above and below the joined core slabs using an adhesive. The laminated structure is then cut into individual panels.

While MDI's systems can produce laminated composite panels of custom lengths, there is no known method of producing frame composite panels of the improved sort in Dickens' '334 patent, of lengths larger than a mold.

It is therefore an object of an aspect of the invention to provide a novel method of forming frame-type composite building panels.

SUMMARY OF THE INVENTION

According to an aspect of the invention, a method of manufacturing composite building panels having a core and a frame comprises: forming an elongate slab of core material; attaching frame members to the slab to form a core-frame composite in which portions of each of the frame members are received in respective slots on said slab; and separating individual composite panels from the core-frame composite.

The elongate slab may be formed by aligning and joining slab portions that have been cut from a block mold, end-to-end.

The slots may be cut during the cutting of slab portions from the block mold with a hot wire or the like, or after the slab portions have been aligned and joined using a slot-cutting device.

The frame members may be formed of continuously roll-formed sheet metal, discrete frame pieces, or a hardenable material that is poured into the slots.

In another aspect of the invention there is provided, in a system for manufacturing composite building panels having a core and a frame, a device for cutting slots in a slab of core material to receive portions of the frame. The device comprises at least one rotatable drum; a plurality of protrusions depending from the at least one rotatable drum; wherein each of the protrusions cuts a respective one of the slots when the at least one rotatable drum is rotating and the protrusions are contacting and moving across the elongate slab.

Preferably, the protrusions are rings that are coaxial with the drum.

The drum's surface may have a diamond coating for sanding the surface of the core while slots are being cut into the slab.

In a system for manufacturing composite building panels having a core and a frame, a method of processing the core comprises removing slab portions of core material from a block of the core material; aligning the slab portions end-to-end; connecting the slab portions to form a slab; and forming slots for receiving a respective one of a portion of an elongate frame member into the slab.

The composite building panel manufacturing method provides advantages in that length of panel is not restricted to the size of the mold for molding the core of the panel, as is known when manufacturing frame type composite panels. Furthermore, different sized panels may be cut from the same core-frame composite.

BRIEF DESCRIPTION OF THE DRAWINGS

Embodiments will now be described more fully with reference to the accompanying drawings in which:

FIG. 19 is a perspective view of several slab portions each having flat end faces being lined up end-to-end for connection to form a slab, according to an alternate embodiment of the invention;

FIG. 20 is a side view of the lined up slab portions of FIG. 19;

FIG. 21 is a side partial view of two slabs portions of core material being lined up end-to-end for connection using a key, according to an alternate embodiment of the invention;

DETAILED DESCRIPTION OF THE EMBODIMENTS

According to the invention in its most general aspect, frame-type composite panels are manufactured by forming an elongate slab of core material, adhering elongate frame members to slots in the core material to form a core-frame composite, and then cutting individual panels from the core-frame composite. The embodiments described hereafter are with reference to a frame-type composite panel having a polystyrene core and a frame of sheet metal strips or a poured hardenable material. However, the invention is applicable to the manufacture of composite panels employing different core and frame materials, as well as variations in configurations.

Figure 9:
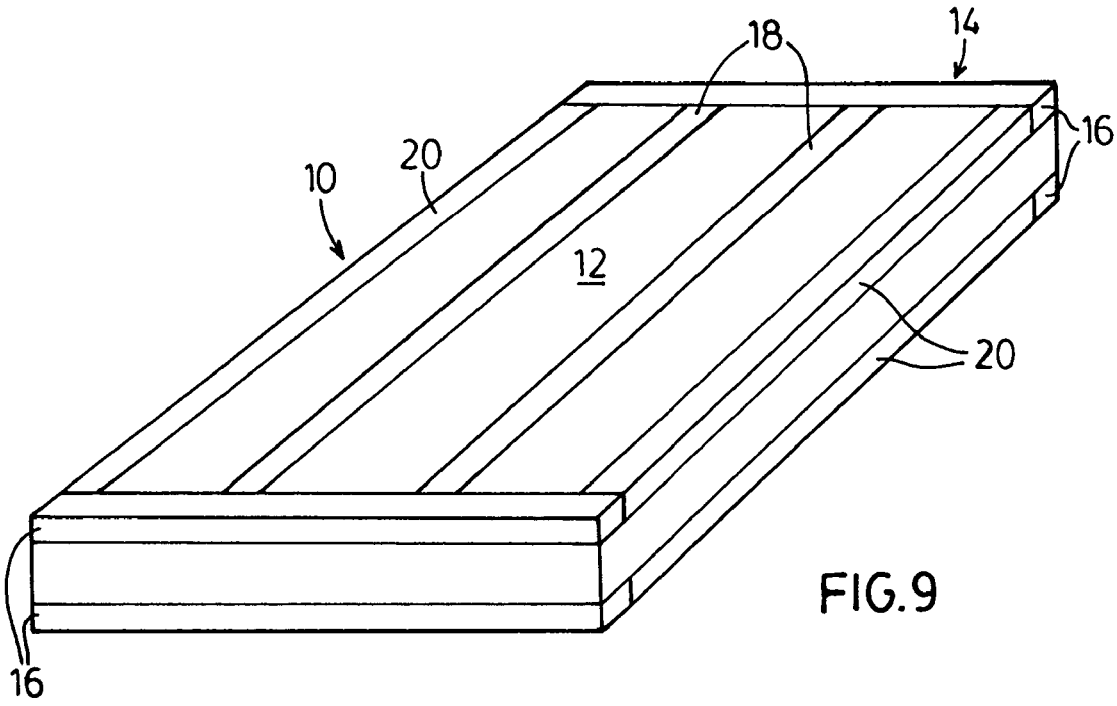
FIG. 9 is a perspective view of a completed frame-type composite panel having an insulating core and a frame.

FIG. 9 shows a perspective view of a composite panel 10 having an insulating core 12, and a frame 14 affixed to insulating core 12. Insulating core 12 is made of polystyrene. Frame 14 comprises end strips 16, face strips 18 and side strips 20, all of sheet metal. Face strips 18 and side strips 20 have bent over edges which extend into insulating core 12 to provide stiffening. The bent-in edges of face strips 18 are not visible in FIG. 9.

Figure 1:
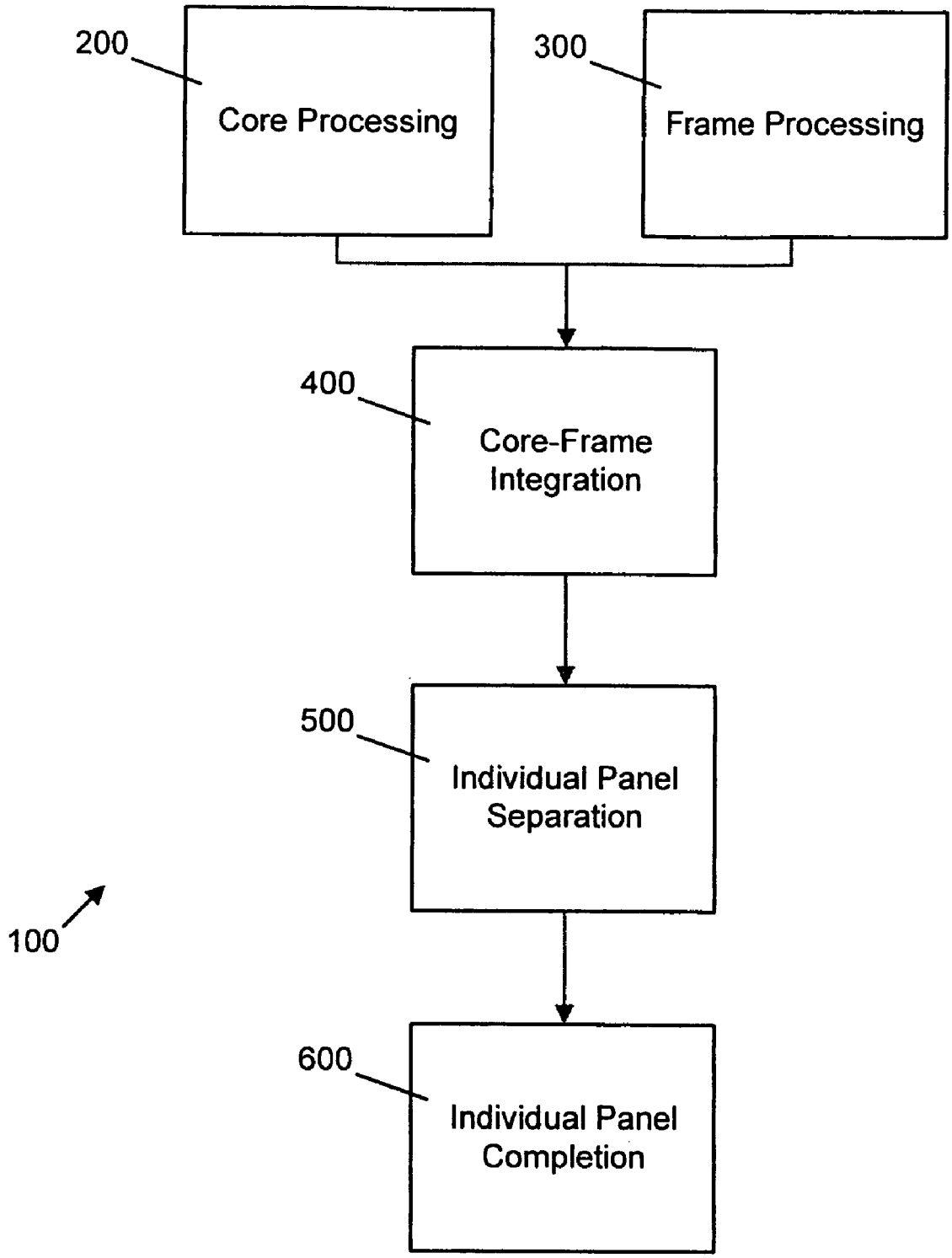
FIG. 1 is a process diagram showing the general stages of manufacturing a composite panel, including core processing; frame processing; core-frame integration; individual panel separation and individual panel completion.

According to the embodiments described herein, and with reference to the process diagram of FIG. 1, composite panel 10 is manufactured using a method (shown generally with reference character 100), that comprises five stages: core processing (stage 200); frame processing (stage 300); core-frame integration (stage 400); individual panel separation (stage 500); and individual panel completion (stage 600).

Figure 2:
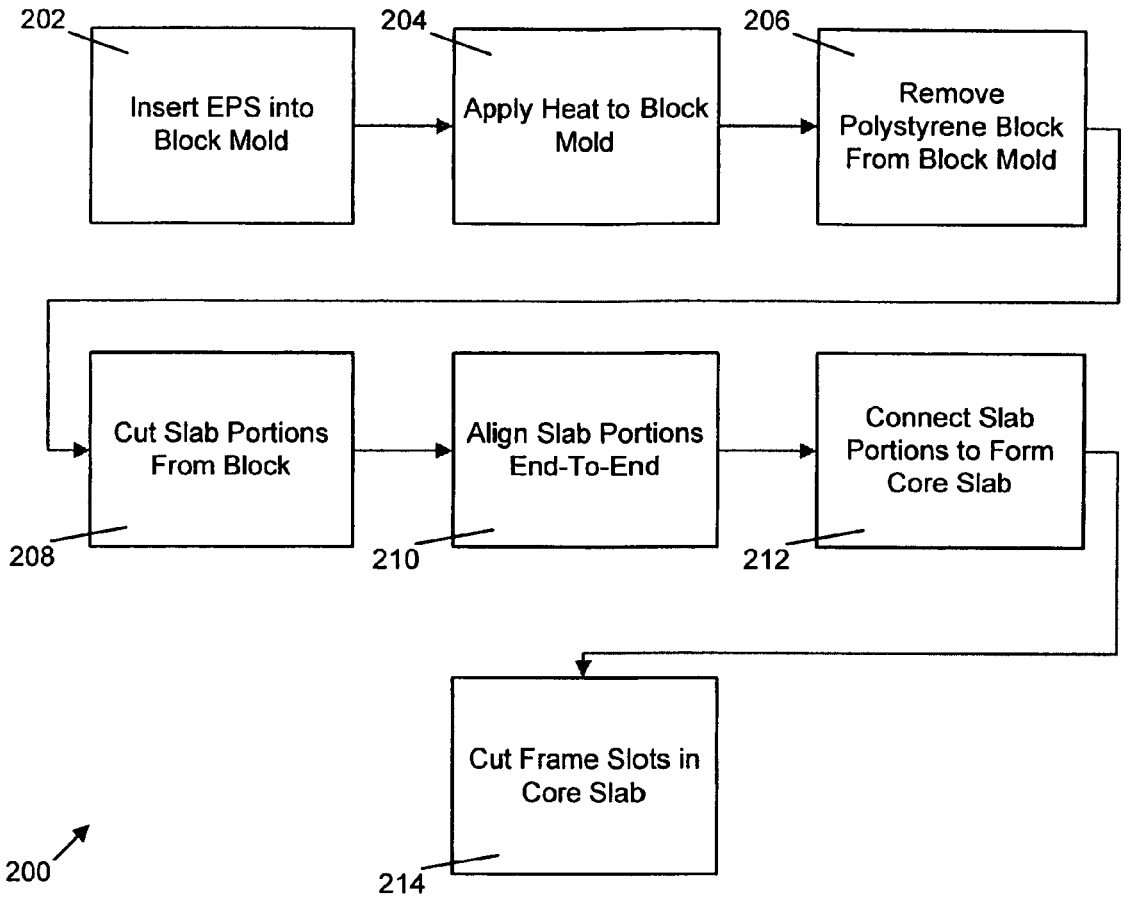
FIG. 2 is a process diagram showing steps of which the core processing stage of FIG. 1 is comprised.

FIG. 2 is a process diagram of the general steps of core processing (stage 200), which are identified by 200-series reference characters. FIGS. 10 to 13 are diagrams of the physical elements involved in the general steps of core processing shown in FIG. 2.

Core processing (stage 200) begins by inserting a volume of EPS beads into a large block mold (step 202). The mold is closed and then heat is applied to the beads by energizing heating elements within the mold (step 204). Under the influence of the heat, the EPS beads expand to fill the mold. Sufficient expansion of the beads has occurred when the block mold is filled uniformly with a block 30 of expanded polystyrene. Block 30 is then removed from the block mold (step 206).

Figure 10:
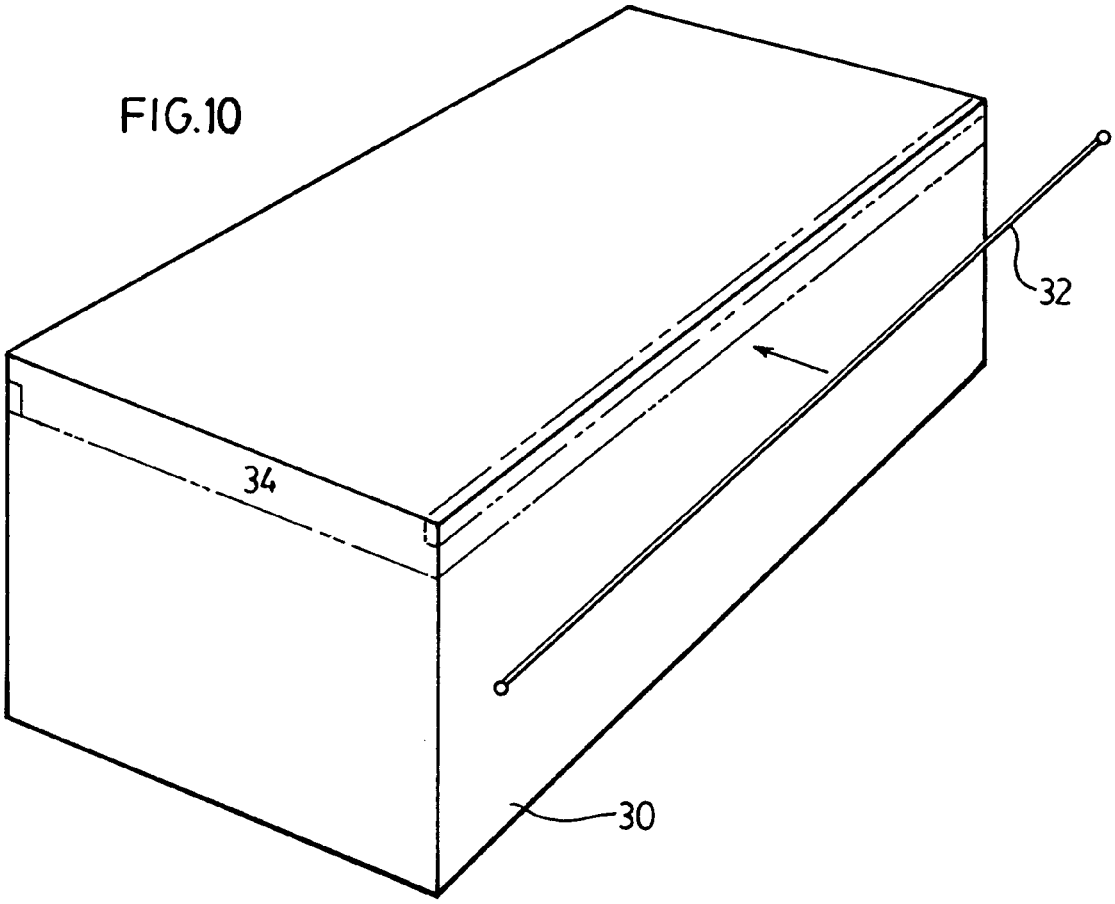
FIG. 10 is a perspective view of a slab portion of core material being cut from a block of polystyrene by a hotwire.

Core processing (stage 200) continues with cutting slab portions 34 from block 30 (step 208). As can be seen in FIG. 10, hot wire 32 is passed through block 30 in order to sever slab portion 34 from block 30. Hot wire 32 is part of a logic-controlled machine (not shown) programmed to move hot wire 32 and block 30 relative to one another in order that hot wire 32 can make passes through block 30 for cutting slab portions 34 of predetermined thicknesses and edge profiles. By controlling movement of block 30 and/or hot wire 32, slab portions 34 having any desired thickness and edge profile can be removed from block 30.

Figure 11:
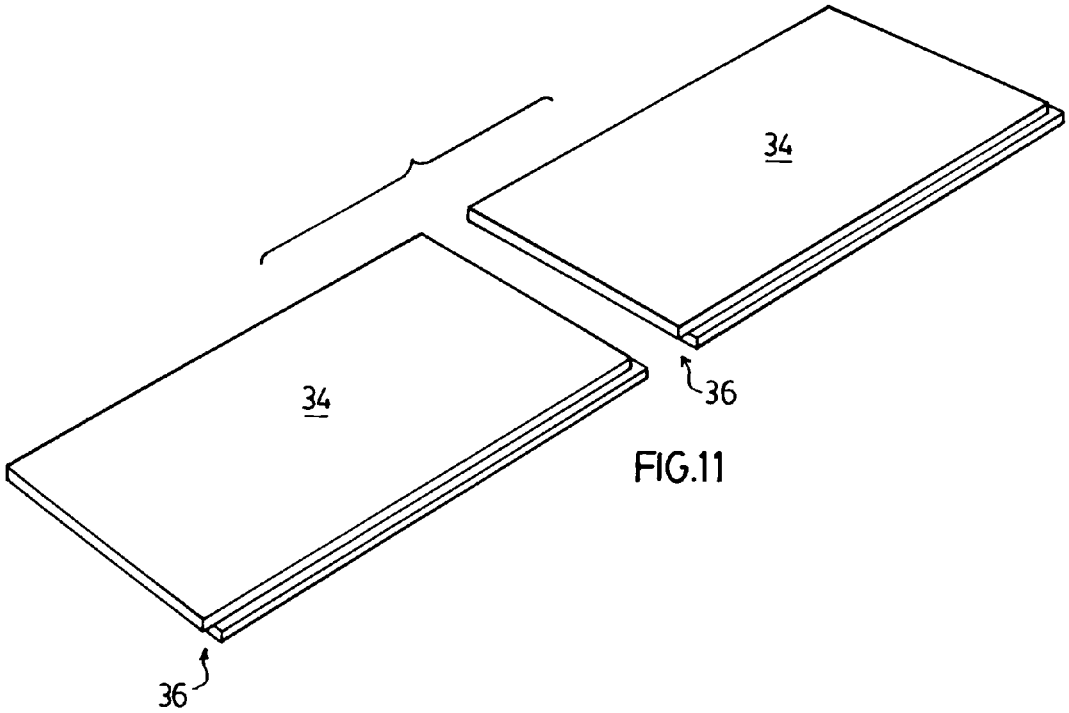
FIG. 11 is a perspective view of slab portions of core material each having stepped end faces being lined up end-to-end for connection.
Figure 12:
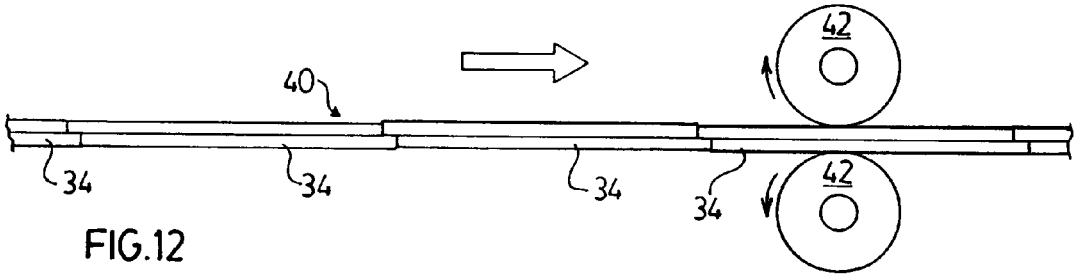
FIG. 12 is a side view of slab portions, connected to form a slab of core material, being passed between slotting drums.

In FIG. 11, two slab portions 34 have been removed from block 30 and are being aligned end-to-end (step 210). It can be seen that a stepped profile 36 has been formed by hot wire 32 in the ends of each of slab portions 34 during removal from block 30. Stepped profile 36 eases the process of alignment and also acts to increase the contacting surface area of adjacent slab portions 34. After alignment of adjacent slab portions 34 (step 210), adjacent slab portions 34 are connected (step 212) to form a slab 40 for further core processing. As can be seen in FIG. 12, slab 40 comprises a number of slab portions 34, which have been connected in a series using a polystyrene adhesive.

As can also be seen in FIG. 12, slab 40 comprising connected slab portions 34 is passed between two slotting drums 42 in order to cut frame slots 44 (step 214) into the two faces of slab 40. Frame slots 44 are cut into slab 40 in order to receive bent-in edges of face strips 18 and side strips 20 of frame 14, as will be described below.

Figure 13:
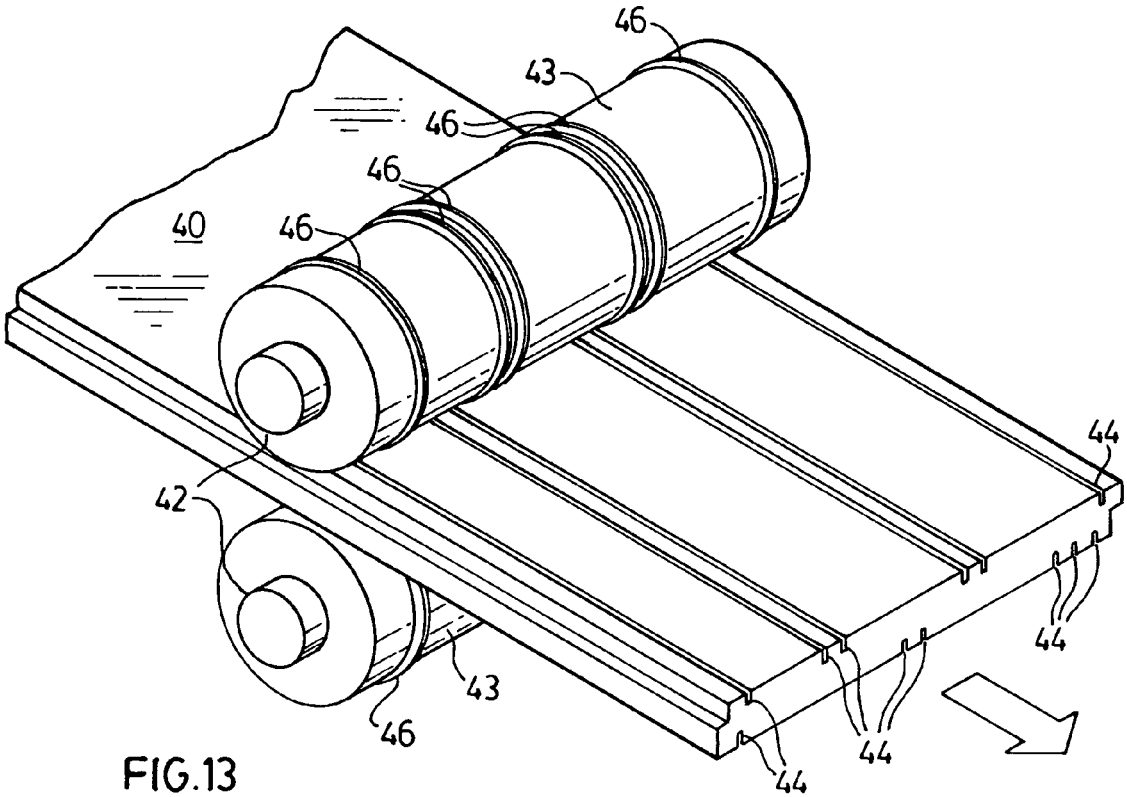
FIG. 13 is a perspective view of the slotting drums and the resultant slots in the slab of core material.

A perspective view of slotting drums 42 and their effect on slab 40 to cut frame slots 44 is shown in FIG. 13. A number of rings 46 are concentrically mounted on each slotting drum 42 and each ring 46 protrudes away from respective surfaces 43 of slotting drums 42. As can be seen, each ring 46 corresponds to a slot 44 in slab 40. Slotting drums 42 rotate at the rate that slab 40 is passed therebetween in order to compress the polystyrene to form slots 44 without tearing away chunks of polystyrene.

Figure 3:
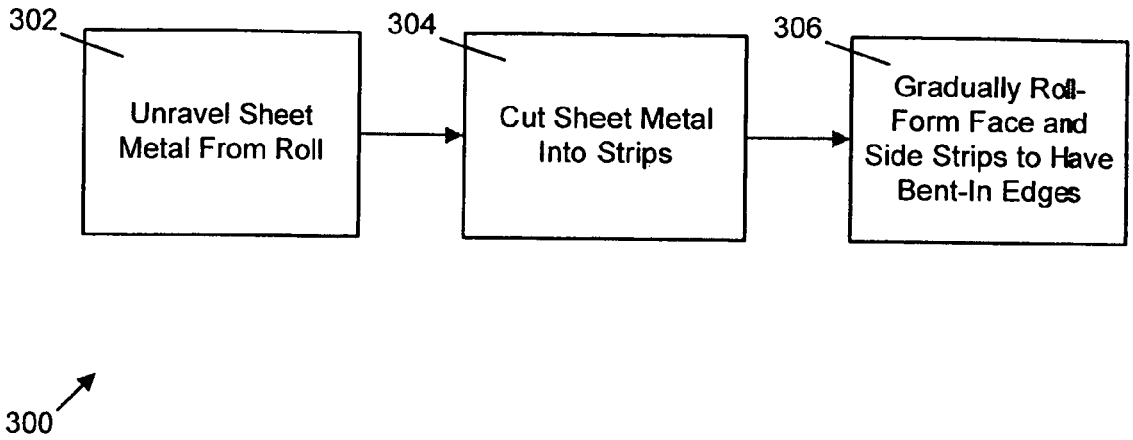
FIG. 3 is a process diagram showing steps of which the frame processing stage of FIG. 1 is comprised.

FIG. 3 is a process diagram of the general steps of frame processing (stage 300), which are identified by 300-series reference characters. Frame processing (stage 300) entails the formation of face strips 18 and side strips 20 of frame 14.

Frame processing (stage 300) begins by unraveling sheet metal from a large continuous roll of sheet metal (step 302). As the sheet metal is unrolled (step 302), it is divided into continuous individual strips (step 304) corresponding to face strips 18 and side strips 20 of frame 14. The ends of the individual strips are then slowly roll-formed (step 306) in roll-forming machines, as would be understood by those of skill in the art, to create bent-in edges. The bent-in edges are dimensioned to be received in respective slots 44 of slab 40, as will be described below.

It will be understood that core processing (stage 200) and frame processing (stage 300) are performed simultaneously.

Figure 4:
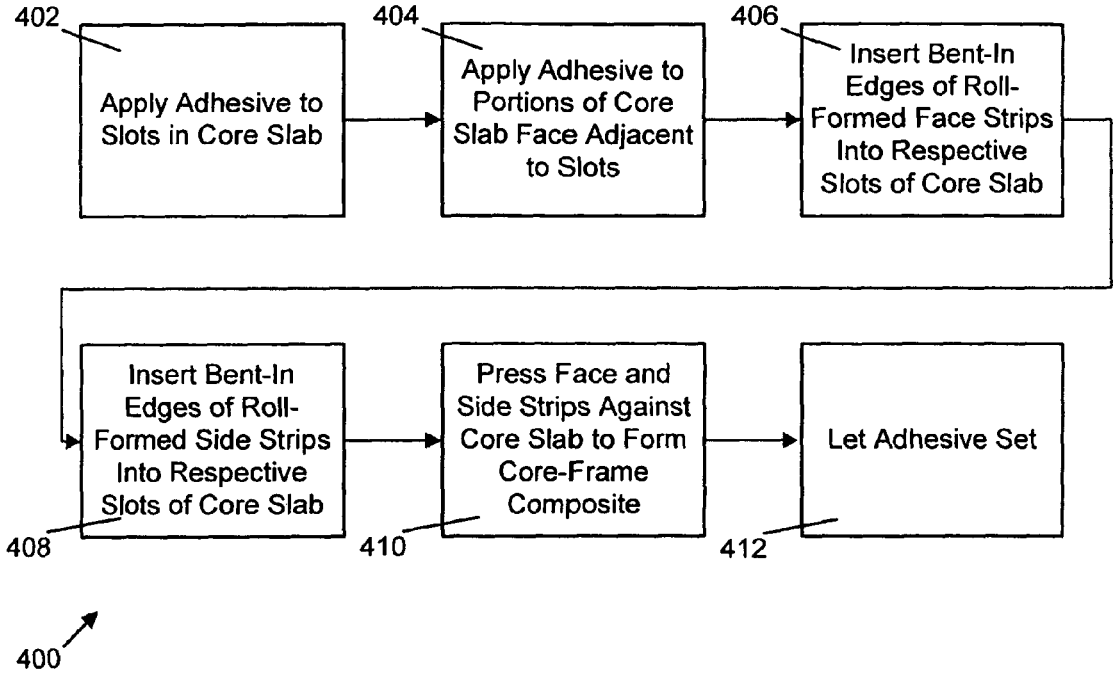
FIG. 4 is a process diagram showing steps of which the core-frame integration stage of FIG. 1 is comprised.
Figure 14:
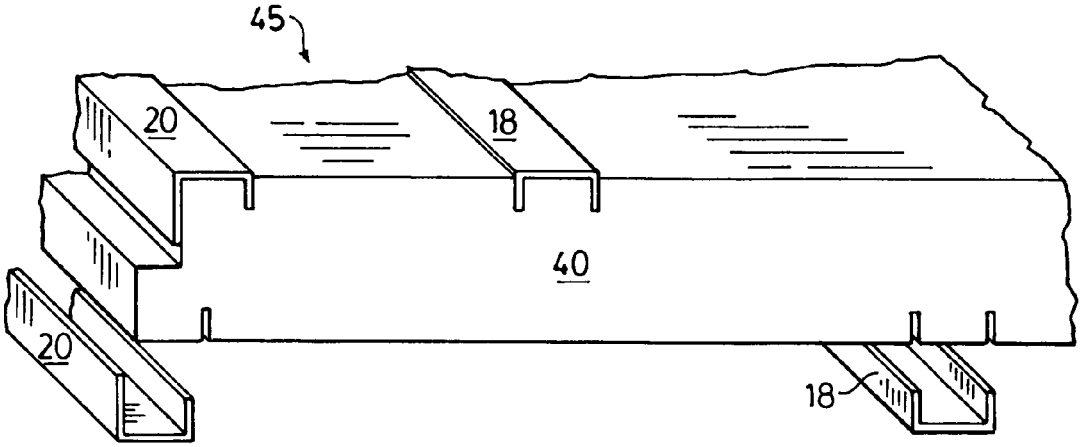
FIG. 14 is a perspective partial view of side and face frame strips being inserted into the slots in the slab of core material.
Figure 15:
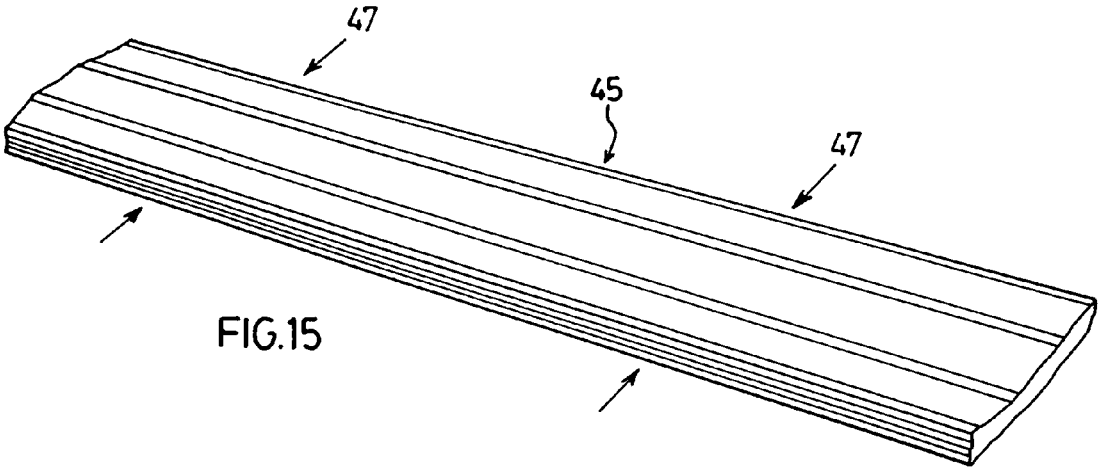
FIG. 15 is a perspective view of the core-frame composite comprising side and face frame strips and the slab of core material, with arrows showing cut-points for separating an individual panel therefrom.

FIG. 4 is a process diagram of the general steps of core-frame integration (stage 400), which are identified by 400-series reference characters. FIGS. 14 and 15 show the integration of core slab 40 and frame strips 18 and 20 to form a core-frame composite 46.

Core-frame integration (stage 400) begins by applying adhesive into slots 44 of slab 40 (step 402). Adhesive is also applied to portions of the faces and sides of slab 40 that are adjacent to slots 44 (step 404). Adhesive may be applied using a series of spouts or a wiper system for wiping adhesive across the faces and sides of slab 40, as would be understood by one of ordinary skill in the art.

Core-frame integration (stage 400) continues with the insertion of bent-in edges of individual face strips 18 formed during frame processing (see stage 300) into respective slots 44 in slab 40 (step 406). At the same time, bent-in edges of individual side strips 20 formed during frame processing (see stage 300) are inserted into respective slots 44 in slab 40 (step 408). As the insertions are being done, face strips 18 and side strips 20 are pressed against respective portions of the faces of slab 40 (step 410) in order to come into contact with the adhesive applied to the faces of slab 40 and to seat bent-in edges of face strips 18 and side strips 20 into their respective slots 44. The adhesive is then allowed to set (step 412). The result of the core-frame integration (stage 400) described above is core-frame composite 46 from which individual panels may be cut, as described below.

It is evident in FIG. 14 that side strips 20 have a slightly different profile than face strips 18 in order to provide structural integrity to the stepped side of slab 40. Furthermore, face strips 18 are placed in slots that are staggered with respect to those on opposite faces of slab 40. The staggering enables a subsequently-removed panel 10 to maintain sufficient structural integrity near its sides should it be narrowed to a reduced width during building construction.

Figure 5:
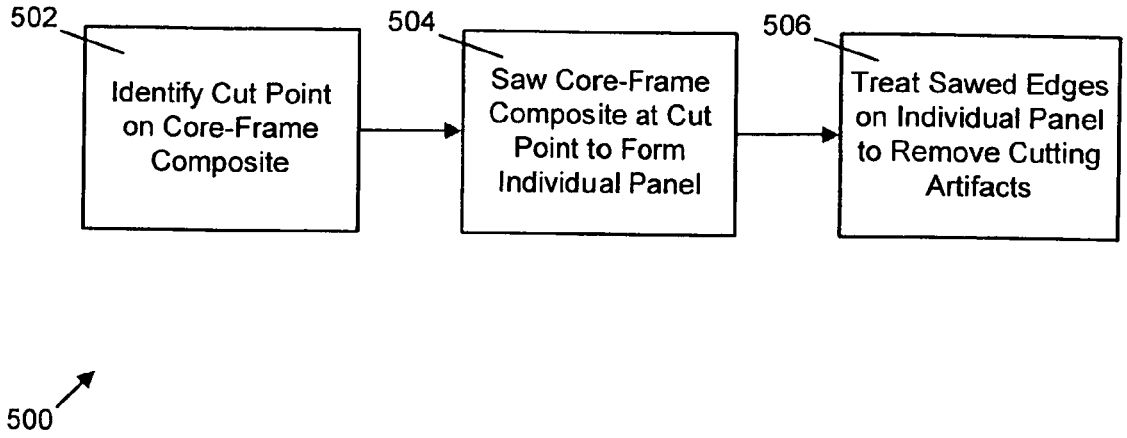
FIG. 5 is a process diagram showing steps of which the individual panel separation stage of FIG. 1 is comprised.

FIG. 5 is a process diagram of the general steps of individual panel separation (stage 500), which are identified by 500-series reference characters. FIG. 15 shows core-frame composite 45 and cut points 47 identifying the points at which individual panels are to be separated from core-frame composite 45.

Individual panel separation (stage 500) begins with an identification of a cut point 47 on core-frame composite 46 (step 502). Identification will be made on the basis of the desired size of panel. Using a band saw, high speed cold wire or the like, core-frame composite 45 is cut at cut points 47 to separate an individual panel 10 (step 504).

Individual panel separation (stage 500) continues with a treatment of the cut ends of panel 10 to remove cutting artifacts such as burrs and the like from ends of face strips 18, side strips 20 and core 12 (step 506). This step facilitates individual panel completion (stage 600) as described hereafter.

Figure 6:
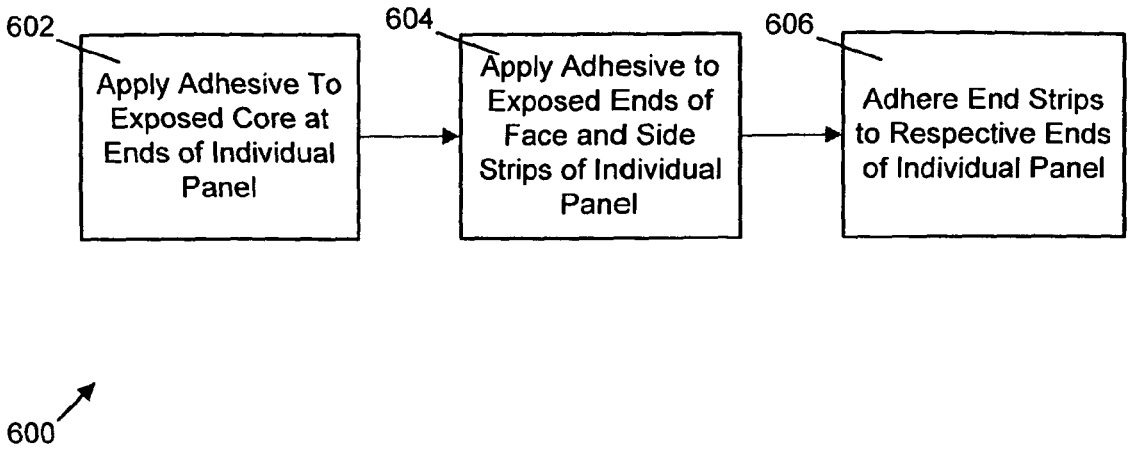
FIG. 6 is a process diagram showing step of which the individual panel completion stage of FIG. 1 is comprise.
Figure 16:
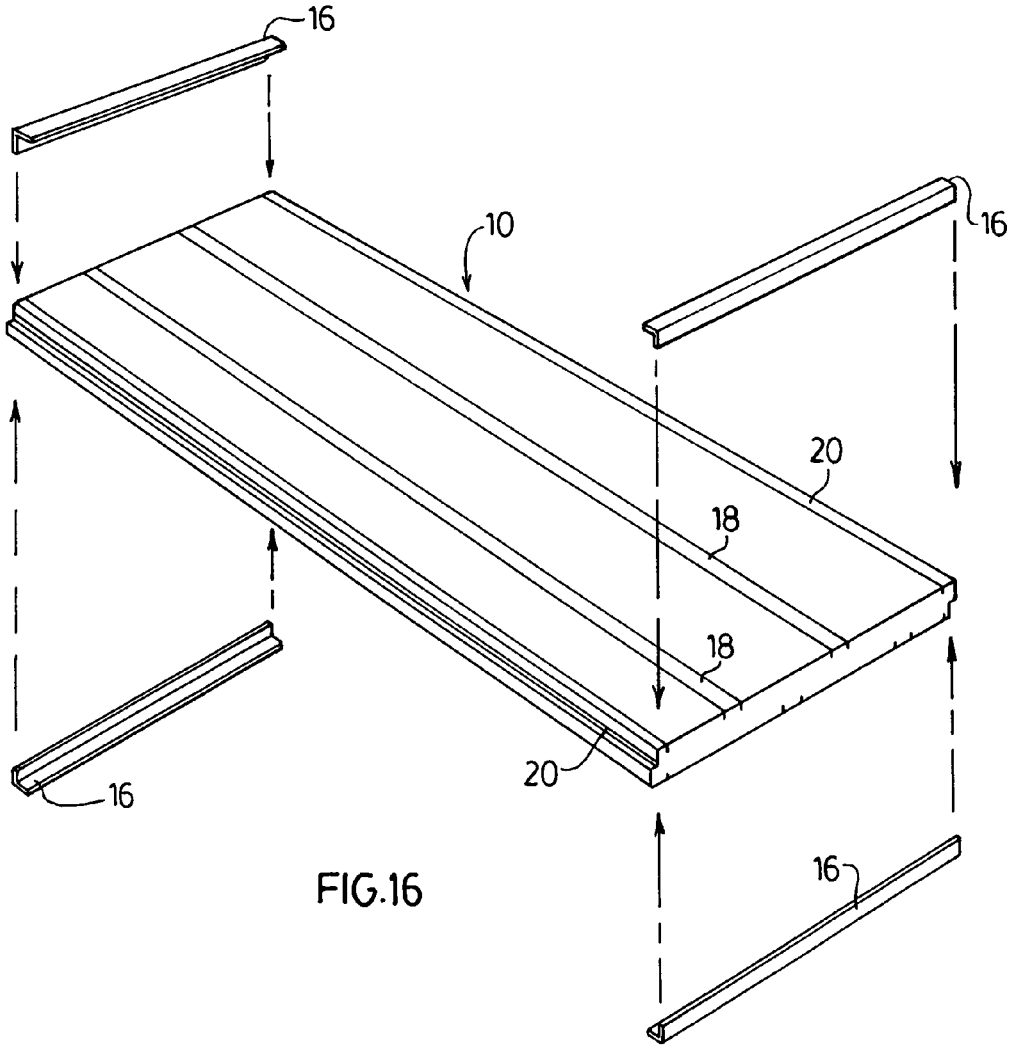
FIG. 16 is a perspective view of the connection of end frame members to an individual panel to complete the frame for the panel.

FIG. 6 is a process diagram of the general steps of individual panel completion (stage 600), which are identified by 600-series reference characters. FIG. 16 is a diagram showing end strips 16 being adhered to panel 10 during panel completion.

Individual panel completion (stage 600) begins with application of adhesive to exposed portions at ends of core 12 (step 602). Adhesive is also applied to exposed portions of face and side strips 18 and 20 at ends of panel 10 (step 604).

Individual panel completion (stage 600) continues with the adhesion of end strips 16 to the ends of panel 10 (step 606).

It can be seen that the above-described method of manufacturing a frame-type composite panel 10 does not inherently limit the length of panel 10 to the length of the mold. The size of panel 10 is limited only to the length of core-frame composite 46 that is able to be supported by processing machinery prior to cutting to panel length.

A number of alternative methods for manufacturing composite panel 10 may be contemplated by one of ordinary skill in the art without departing from the spirit and scope of the invention described herein.

Figure 7:
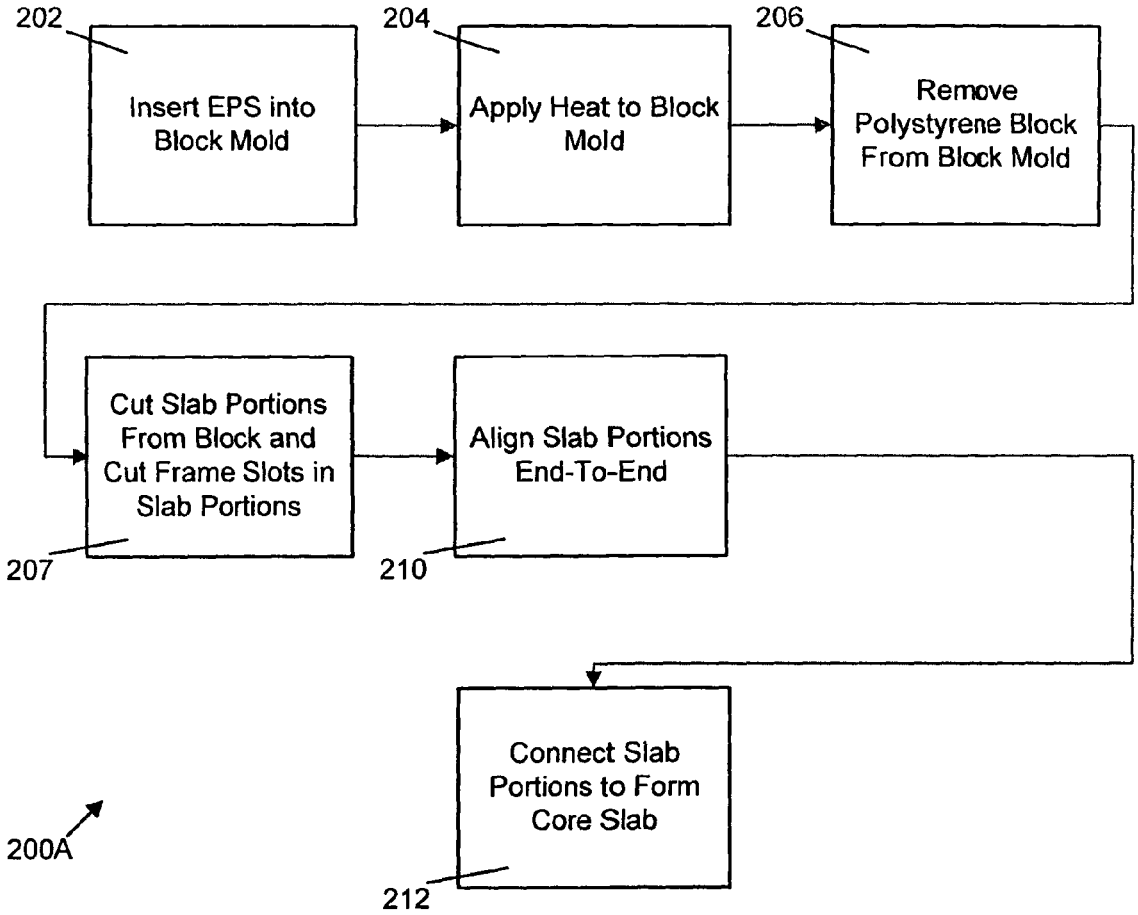
FIG. 7 is a process diagram showing alternate steps for completing the core processing stage of FIG. 1.
Figure 17:
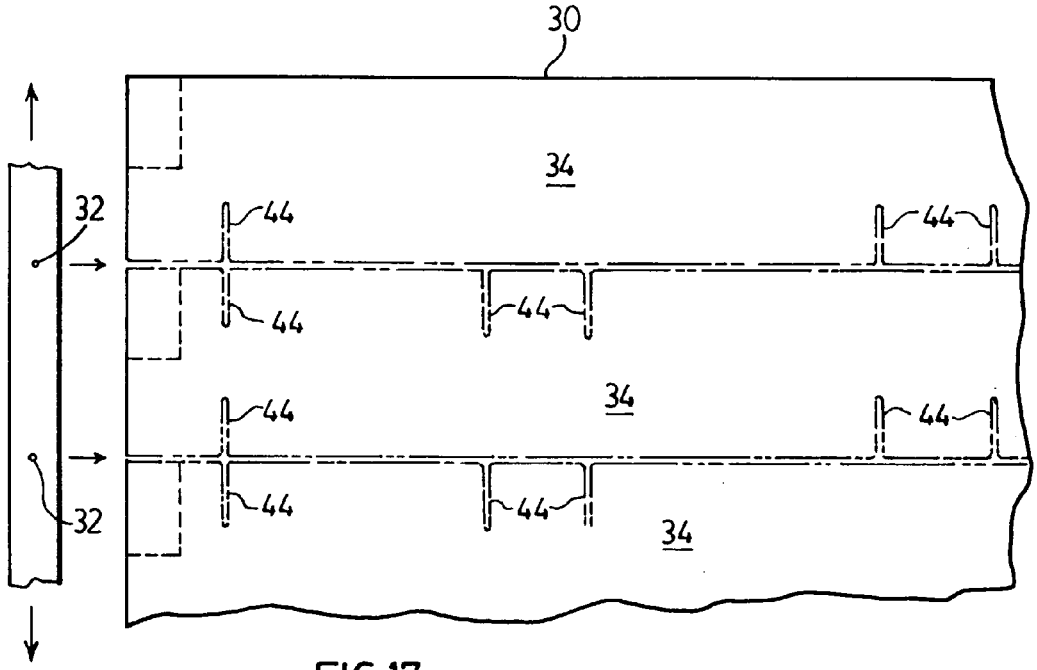
FIG. 17 is, according to an alternate embodiment of the invention, an end cutoff view of a block of polystyrene in which slab portions are being cut wherein frame slots are being formed in two of the slab portions by hotwires.

For example, with reference to FIGS. 7 and 17, there is shown an alternate embodiment in an end view of a block 30 of EPS in which slab portions 34 are being cut and frame slots 44 are being formed (step 207) in two of the portions by a machine having multiple hotwires 32. As such, it can be seen that slotting drums 42 are not subsequently required to form slots 44 in slab 40.

Figure 8:
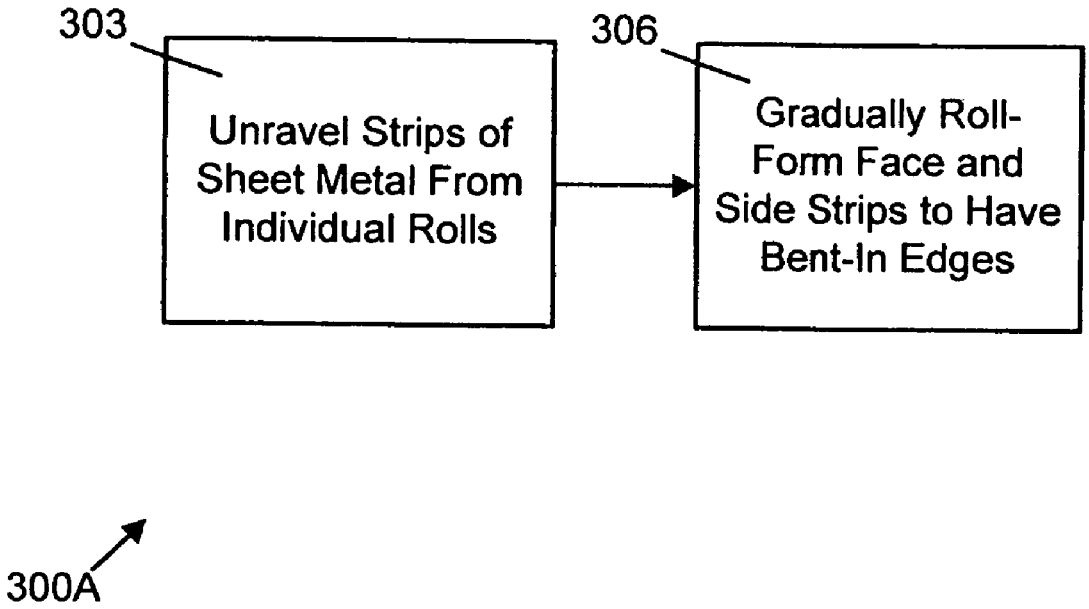
FIG. 8 is a process diagram showing alternate steps for completing the frame processing stage of FIG. 1.

As a further example of alternative methods, FIG. 8 is a process diagram of alternative steps for frame processing (stage 300). Individual rolls of sheet metal may be provided, and thus it is no longer required to cut the sheet metal into individual strips. The individual rolls are simply unraveled (step 303), and roll-formed (step 306) to have bent-in edges.

Figure 18:
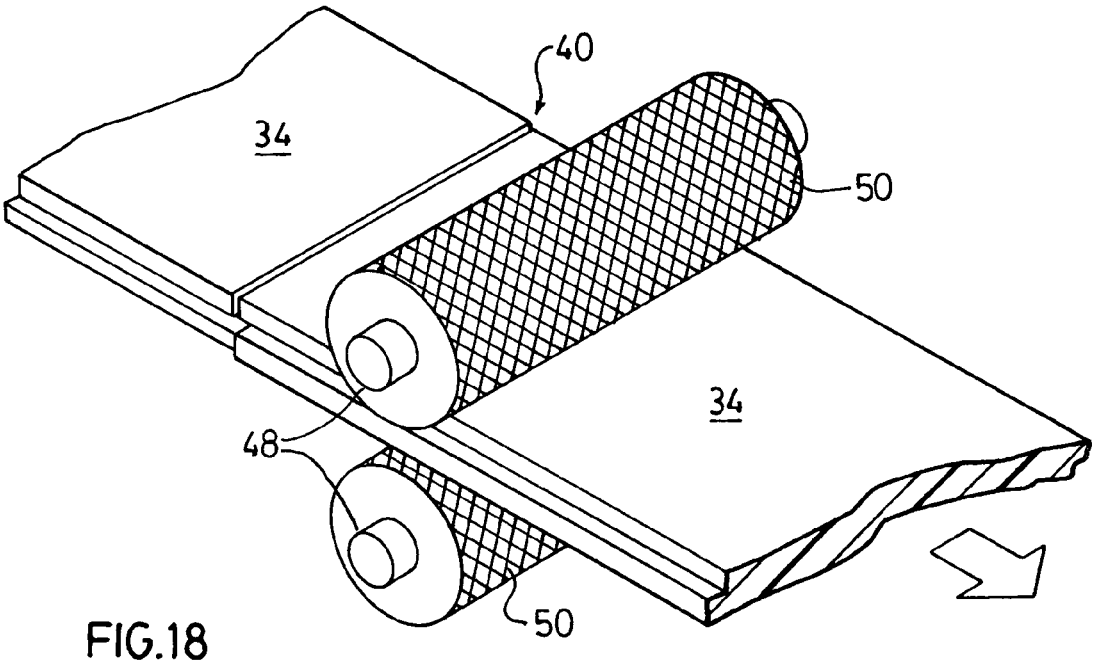
FIG. 18 is a perspective view of sanding drums for conforming all of the slab portions in the slab of core material to a particular thickness.

With reference to FIG. 18, whether cutting slots 44 in slab 40 or in slab portions 34, it is desirable to pass slab 40 between sanding drums 48 in order to ensure that slab 40 is uniform in thickness, and has an excellent surface for frame adhesion. Sanding drums are similar to slotting drums 42 described above but are without rings 46 and have a rough, diamond-coated surface 50. Slotting drums 42 may also have such a rough surface 50, and perform sanding at the same time as they are cutting slots 44.

Furthermore, with reference to FIG. 19, there are shown slab portions 34 which, unlike those shown in FIGS. 11 and 12, are without stepped profiles 36 on their ends. The slab portions 34 illustrated in FIG. 19 may, however, be connected to one another in a similar manner as are their stepped counterparts as shown in FIG. 20. It will be understood that ends of slab portions 34 may be profiled as desired, depending on requirements, costs and available equipment.

For instance, an alternate joint for slab portions 34 is shown in FIG. 21. The ends of slab portions have cut-ins 54 for each receiving a part of key 52. Key 52 may be made of polystyrene or any other suitable material, and may be adhered into cut-ins 54 and/or interference-fit as necessary. Cut-ins 54 may be formed in slab portions 34 using hot wire 32 during cutting of slab portions 34, or another suitable system such as a small sander.

Figure 22:
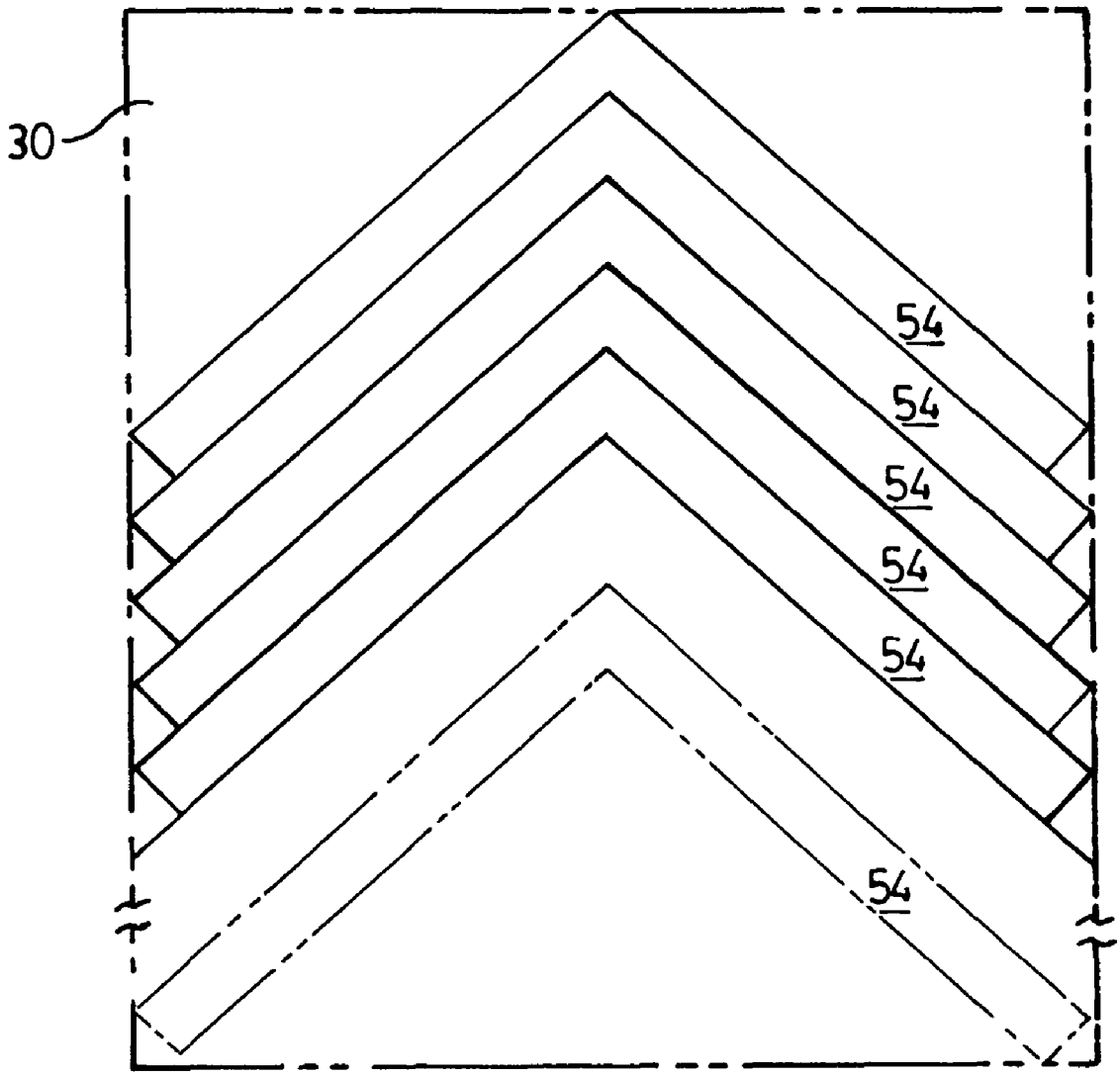
FIG. 22 is an end view of a block of polystyrene from which v-shaped slabs may be removed, according to an alternate embodiment of the invention.
Figure 23:
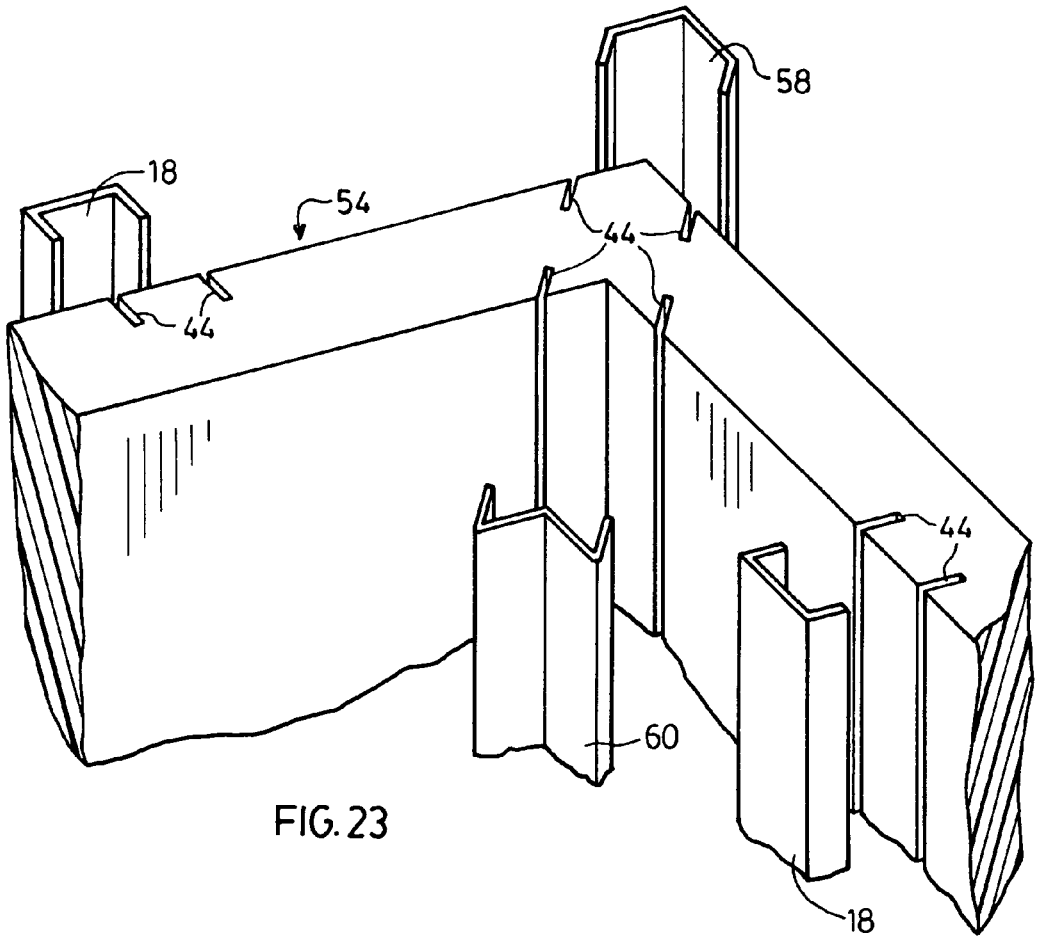
FIG. 23 is a perspective view of the frame-core cooperation of one of the v-shaped slabs of FIG. 22 having the V-shaped cross section.
Figure 24:
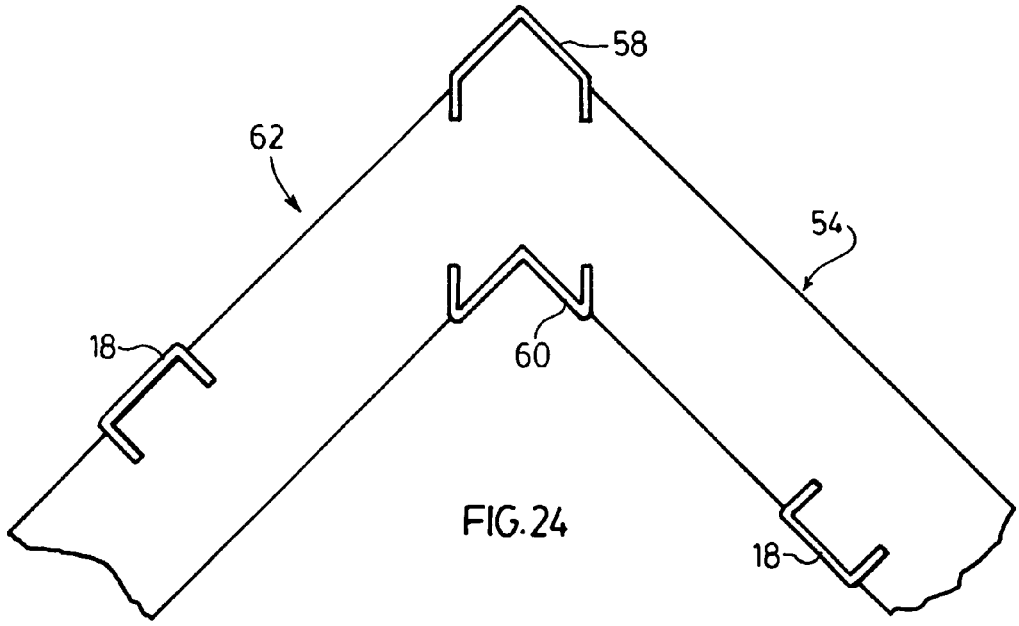
FIG. 24 is an end view of the frame-core cooperation of FIG. 23.

The invention disclosed herein is applicable to various shapes of panels. For example, FIG. 22 is an end view of a block 30 of polystyrene in which an alternate insulative core in the form of a v-slab 54 is shown. V-slab 54 is usable for providing insulating through building corners. FIG. 23 shows a roll-formed outer corner strip 58, an inner corner strip 60, and face strips 18 forming a v-frame over top of corresponding slots 44 in v-slab 54. FIG. 23 is an end view of the relationship between frame strips 18, 58 and 60 and v-slab 54 of v-core-frame composite 62. It will be understood that alternatives may be contemplated such as corners being be provided with two distinct flat slab portions 34 having mitred edges and adhered or simply held together using inner and outer corner strips 58 and 60.

Figure 25:
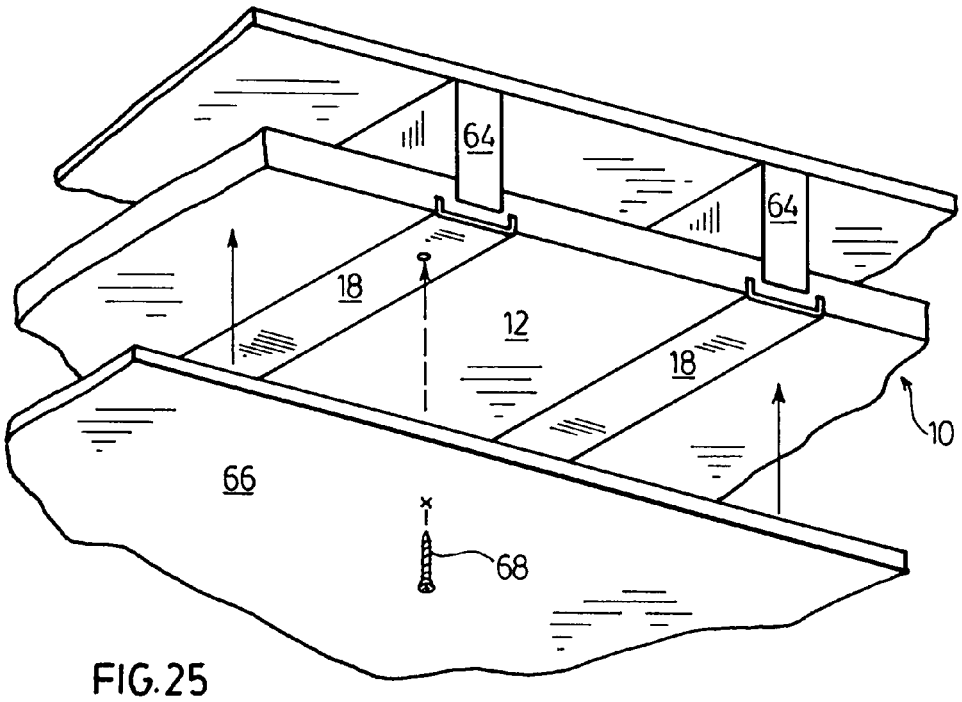
FIG. 25 is a perspective view of a composite panel being installed adjacent to floor joists in a building.
Figure 26:
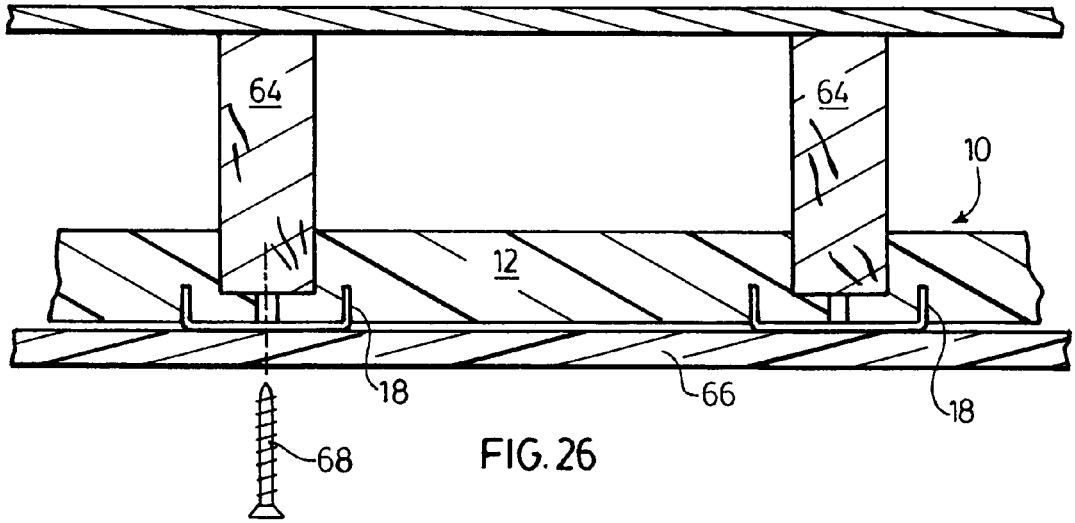
FIG. 26 is an end view of the composite panel installation of FIG. 25.

FIG. 25 shows a relationship between flat composite panel 10, floor joists 64 and drywall sheet 66. As can be seen, face strips 18 align during building construction with floor joists 64, and are attached through core 12 to floor joists 64. This alignment is important for compliance with building codes in many jurisdictions, as an attachment of panel 10 merely by attachment of core 12 to joists 64 is likely to fail in the event of fire due to melting of the polystyrene. To prevent drywall sheet 66 or other similar covering from falling from the ceiling, drywall sheet 66 is fastened through face strips 18 to joists 64 using a screw 68 or other suitable fastener. Alternatively, drywall 66 is fastened to face strips 18, which are, in turn, fastened to joists 64. FIG. 26 is an end view of the relationship shown in FIG. 25.

Guidelines may be scored into the faces of composite panels 10 in order to provide a builder with guidance as to the location of joists 64 etc. These guidelines may be formed in the face of an individual panel 10, slab portion 34 or slab 40 in a similar manner to that in which slots 44 are formed. Furthermore, holes could be pre-punched in the frame strips 18, 20 and/or 22 and through the core 12 in order to facilitate attaching panel 10 to a building using a fastener during construction.

It will be understood that rings 46 of slotting drums 42 may have a diamond or other suitable coating so as to cut away slots 44 in slab 40, rather than compress the polystyrene to form slots. If slots 44 are cut in this manner, then slotting drums 42 would turn at a rate faster than that at which slab 40 is passed therebetween.

The face strips 18 can be adhered into slots 44 of slab 40 directly across from each other, rather than staggered. Of course, the thickness of the core is a factor in maintaining the core's rigidity in view of slots 44 being cut into the faces of slab 40 directly across from each other.

It is preferred that strips forming frame 14 be continuously unrolled and roll-formed due to the availability of rolls of sheet metal, and the continuity of the above-described process for large-scale production. However, it is conceivable that strips forming frame 14 be molded to predetermined shapes instead of roll-formed, and/or adhered to slab 40 in predetermined quantums prior to cutting individual panels 10. Numerous variations may be conceived without departing from the spirit and scope of the invention.

As an alternative to using rolls of sheet metal and the like, a more fluid, hardenable material may be poured into the slots, where adhering occurs when the hardenable material bonds with the slab and is hardened to form the structural properties required by a panel. The instant inventor proposes a hardenable slurry such as a combination of Portland cement, high alumina cement, crystalline silica, glass or plastic fiber, and polymers. The time for such a slurry to harden depends on a number of factors, but primarily on the properties of the chosen polymers, and generally ranges from 10-45 minutes. Optionally, the slurry can be poured in such a manner that it enters into the slots and also provides a coating over at least a portion of the slab surface. The core-frame composite may be separated into individual composite panels either before hardening of the hardenable material or after.

A layer of finish material comprising crushed granite, marble or the like may be applied to the hardenable slurry after its application to the panel, but before it has fully hardened such that during hardening the finish material bonds with the hardenable slurry. Upon hardening of the slurry the finish material provides an attractive finishing surface to the panel. The core-frame composite may be separated into individual composite panels either before application of the finish material or after.

It will be understood that the methods of manufacturing described herein may be used to form panels of various frame configurations and frame-core relationships. The core material described herein is not restricted to polystyrene or expandable polystyrene, or even insulating-quality material, but may be any material desired for construction of a frame-type composite panel.

Although embodiments have been described, those of skill in the art will appreciate that the variations and modifications may be made without departing from the spirit and scope of the invention as defined by the appended claims.

What is claimed is:

1. A method of manufacturing composite building panels having a core and a frame, comprising:

forming an elongate slab of core material, comprising molding a block of core material, separating slab portions from the block, aligning the slab portions end-to-end and connecting said slab portions to form said elongate slab;

attaching frame members to said slab to form a core-frame composite in which portions of each of said frame members are received in respective slots on said slab; and separating individual composite panels from said core-frame composite.

2. The method of claim 1, wherein said attaching comprises:

pouring a hardenable material into said slots; and bonding said hardenable material to said slab.

3. The method of claim 2, wherein said pouring further comprises pouring said hardenable material across a face of said slab.

4. The method of claim 3, further comprising:

after said pouring, applying a finish material over the hardenable material on said slab; wherein said finish material bonds to said hardenable material.

5. The method of claim 4, wherein said finish material is at least one of crushed granite and crushed marble.

6. The method of claim 2, wherein said hardenable material is a slurry comprising Portland cement, high alumina cement, crystalline silica, one of glass and plastic fiber, and polymers.

7. The method of claim 6, wherein a time for hardening of said hardenable material depends on properties of said polymers.

8. The method of claim 7, wherein said time for hardening is between 10 and 45 minutes.

9. The method of claim 2, wherein said separating occurs after hardening of said hardenable material.

10. The method of claim 2, wherein said separating occurs prior to complete hardening of said hardenable material.

11. The method of claim 1, further comprising:

prior to said attaching, cutting said slots into said elongate slab.

12. The method of claim 11, wherein said cutting comprising bringing a plurality of protrusions on at least one rotating drum into contact with said elongate slab, each of said protrusions cutting a respective one of said slots when contacting and moving across said elongate slab.

13. The method of claim 12, wherein a surface of said rotating drum is adapted to uniformly smooth a surface of said elongate slab when a surface of said rotating drum is contacting and moving relative to said surface of said elongate slab.

14. The method of claim 1, further comprising: during said separating said slab portions, cutting said slots into each of said slab portions.

15. The method of claim 14, comprising removing and cutting with a hot wire.

16. The method of claim 14, comprising removing and cutting with a cold wire.

17. The method of claim 1, wherein said forming, attaching and separating are continuous.

18. The method of claim 1, further comprising:

prior to said adhering, roll-forming said elongate frame members from strips of sheet metal.

* * * * *